US007607992B2

(12) United States Patent
Nishio

(10) Patent No.: US 7,607,992 B2
(45) Date of Patent: Oct. 27, 2009

(54) GOLF CLUB HEAD

(75) Inventor: Masayoshi Nishio, Kobe (JP)

(73) Assignee: SRI Sports Limited, Kobe-shi (JP)

( * ) Notice: Subject to any disclaimer, the term of this patent is extended or adjusted under 35 U.S.C. 154(b) by 97 days.

(21) Appl. No.: 11/712,407

(22) Filed: Mar. 1, 2007

(65) Prior Publication Data

US 2007/0207877 A1 Sep. 6, 2007

(30) Foreign Application Priority Data

Mar. 3, 2006 (JP) ..... 2006-058232

(51) Int. Cl.
*A63B 53/04* (2006.01)

(52) U.S. Cl. ..... 473/342; 473/345; 473/347

(58) Field of Classification Search ..... 473/324–350
See application file for complete search history.

(56) References Cited

U.S. PATENT DOCUMENTS

| | | | | |
|---|---|---|---|---|
| 4,535,990 | A * | 8/1985 | Yamada | 473/346 |
| 4,732,389 | A * | 3/1988 | Kobayashi | 473/348 |
| 4,874,171 | A * | 10/1989 | Ezaki et al. | 473/290 |
| 5,242,168 | A * | 9/1993 | Aizawa | 473/332 |
| 5,328,176 | A * | 7/1994 | Lo | 473/342 |
| 6,582,323 | B2 * | 6/2003 | Soracco et al. | 473/342 |
| 6,602,149 | B1 * | 8/2003 | Jacobson | 473/329 |
| 6,612,938 | B2 * | 9/2003 | Murphy et al. | 473/324 |
| 6,623,378 | B2 * | 9/2003 | Beach et al. | 473/345 |
| 6,645,086 | B1 * | 11/2003 | Chen | 473/335 |
| 6,648,773 | B1 * | 11/2003 | Evans | 473/342 |
| 6,648,774 | B1 * | 11/2003 | Lee | 473/342 |
| 6,872,152 | B2 * | 3/2005 | Beach et al. | 473/324 |
| 6,926,618 | B2 * | 8/2005 | Sanchez et al. | 473/329 |
| 6,991,558 | B2 * | 1/2006 | Beach et al. | 473/324 |
| 7,041,005 | B2 * | 5/2006 | Beach et al. | 473/345 |
| 7,070,517 | B2 * | 7/2006 | Cackett et al. | 473/342 |
| 7,101,289 | B2 * | 9/2006 | Gibbs et al. | 473/329 |
| 7,137,907 | B2 * | 11/2006 | Gibbs et al. | 473/329 |
| 7,258,631 | B2 * | 8/2007 | Galloway et al. | 473/345 |
| 2003/0207726 | A1 | 11/2003 | Lee | |
| 2006/0194644 | A1 * | 8/2006 | Nishio | 473/329 |
| 2006/0258482 | A1 * | 11/2006 | Cackett et al. | 473/345 |
| 2007/0066420 | A1 * | 3/2007 | Imamoto et al. | 473/329 |

FOREIGN PATENT DOCUMENTS

| | | | |
|---|---|---|---|
| JP | 07213655 | A * | 8/1995 |
| JP | 2003144590 | A * | 5/2003 |
| JP | 2004229869 | A * | 8/2004 |
| JP | 2005296043 | A * | 10/2005 |

* cited by examiner

*Primary Examiner*—Alvin A Hunter
(74) *Attorney, Agent, or Firm*—Birch, Stewart, Kolasch & Birch, LLP

(57) ABSTRACT

A hollow golf club head comprises: a hollow main body made of a fiber-reinforced plastic; and a face member made of a metal material and forming at least a part of the club face, wherein the hollow main body is single-piece and comprises a front portion of which outer surface is covered with the face member bonded thereto.

9 Claims, 7 Drawing Sheets

GOLF CLUB HEAD

BACKGROUND OF THE INVENTION

The present invention relates to a hybrid golf club head of a metal part and an FRP part Wood-type hollow golf club heads composed of an open-front main body made of a fiber-reinforced plastic and a metal face plate of which outside perimeter is fixed to the main body so as to close the front opening of the main body have been proposed for example as disclosed in US patent application publication US 2003/207726 A1.

In such a structure, as the fiber-reinforced plastics are generally smaller in the specific gravity than the metal materials, the design freedom of the weight distribution of the head is increased. Therefore, the design freedom of the position of the center of gravity of the head is also increased, and it is possible to adjust the center of gravity to a low position as desired. But, when the ball is hit on the metal face plate, the shocks and vibrations thereof concentrate in the junction at the perimeter of the face plate. Therefore, the junction becomes a week point. In particular, as shown in FIG. 11, when the face plate (a) is provided with a turnback (a1), and the turnback (a1) is inserted in a slit (s) formed on the front of the FRP main body (b), cracks are liable to occur at the bottom of the slit confronting the rear end of the turnback (a1).

SUMMARY OF THE INVENTION

It is therefore an object of the present invention to provide a hybrid golf club head in which the concentration of the shocks and vibrations occurring when the ball is hit are avoided, and the strength of the junction is increased, thereby the durability of the head is improved.

According to the present invention, a golf club head comprises a hollow main body made of a fiber-reinforced plastic and a face member made of a metal material and forming at least a part of the club face, wherein the hollow main body is single-piece and comprises a front portion of which outer surface is covered with the face member bonded thereto.

Therefore, the contact area or bonded area of the two parts: the face member and main body is increased, and the formation of such a junction at which the club head material changes from a metal to a FRP or vice versa can be avoided. Therefore, the durability of the head is improved and the joint strength of the face member can be increased. Further, the vibrations of the metal face member at impact can be damped by the fiber-reinforced plastic of the front portion lining the face member, and as a result it is possible to present a good impact feeling for the user.

DESCRIPTION OF THE PREFERRED EMBODIMENTS

Figure 1:
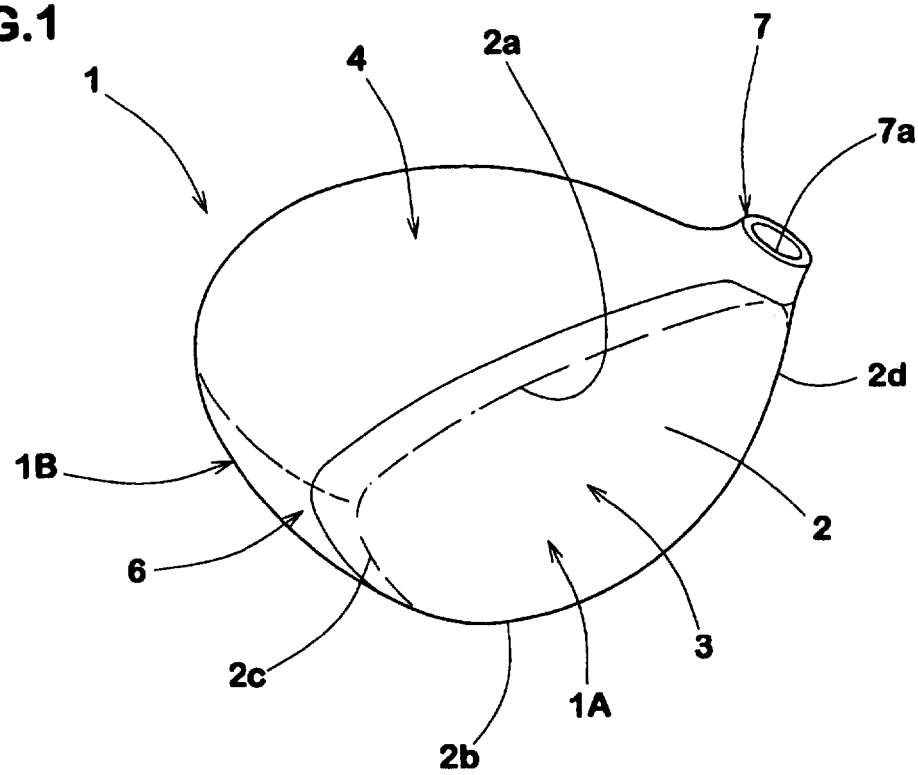
FIG. 1 is a perspective view of a wood-type golf club head according to the present invention.
Figure 2:
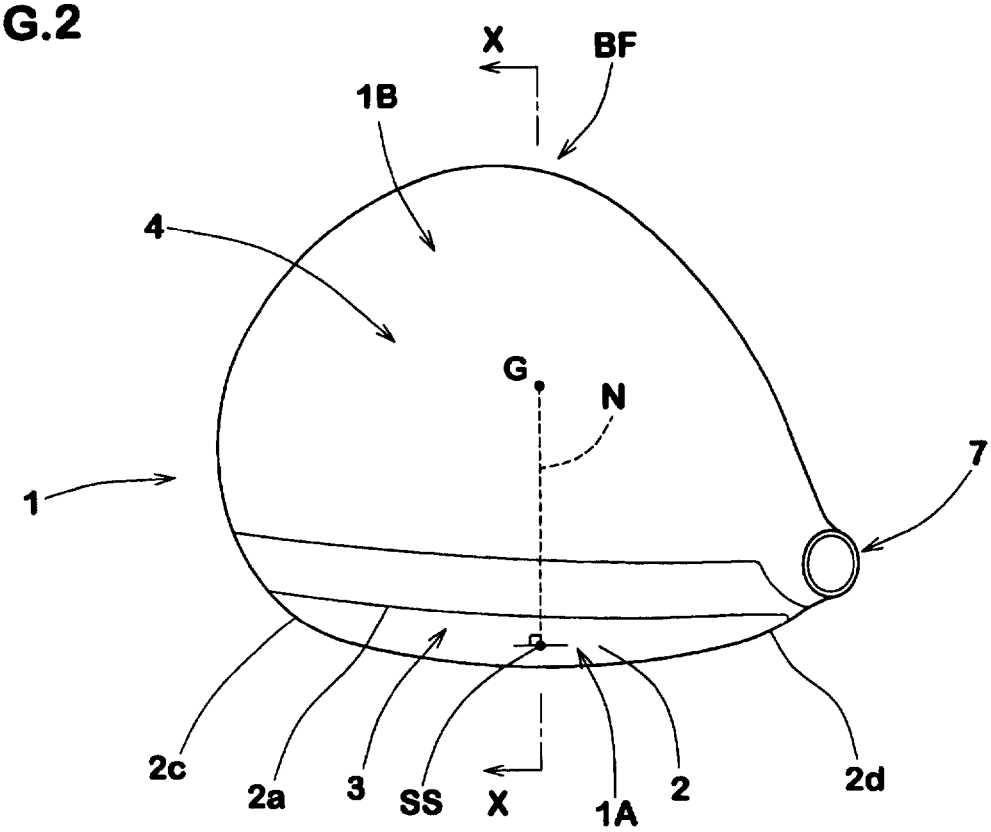
FIG. 2 is a top view thereof.

Embodiments of the present invention will now be described in detail in conjunction with the accompanying drawings.

In the drawings, golf club head 1 according to the present invention is a hollow head for a wood-type golf club such as driver (#1) or fairway wood, and comprises: a face portion 3 whose front face defines a club face 2 for striking a ball; a crown portion 4 defining a top surface of the head intersecting the club face 2 at the upper edge 2*a* thereof; a sole portion 5 defining a bottom surface of the head intersecting the club face 2 at the lower edge 2*b* thereof; a side portion 6 between the crown portion 4 and sole portion 5 which extends from a toe-side edge 2*c* to a heel-side edge 2*d* of the club face 2 through the back face BF of the club head; and a hosel portion 7 at the heel side end of the crown to be attached to an end of a club shaft (not shown) inserted into the shaft inserting hole 7*a*. The club head 1 has a hollow (i).

In the case of a wood-type club head for a driver (#1), it is preferable that the head volume is set in a range of not less than 360 cc, more preferably not less than 380 cc in order to increase the moment of inertia and the depth of the center of gravity. However, to prevent an excessive increase in the club head weight and deteriorations of swing balance and durability and further in view of golf rules or regulations, the head volume is set in a range of not more than 470 cc, preferably not more than 460 cc.

The mass of the club head 1 is preferably set in a range of not less than 170 grams, more preferably not less than 180 grams, but not more than 250 grams, more preferably not more than 240 grams in view of the swing balance and the like. In the case of driver, it is especially preferable that the mass is not more than 200 grams.

According to the present invention, the club head 1 is composed of a single-piece face member 1A made of a metal material, and a single-piece main body 1B made of a fiber-reinforced plastic.

The main body 1B is a hollow shell structure or monocoque structure forming the face portion 3, crown portion 4, sole portion 5, side portion 6 and hosel portion 7.

As for the reinforcing fiber, preferably used are fibers having a tensile elastic modulus in a range of not less than 200 GPa, more preferably not less than 240 GPa, still more preferably not less than 290 GPa, but preferably set not less than 500 GPa when measured according to the Japanese Industrial Standard R7601 "Testing methods for Carbon fibers", 1986. Specifically, carbon fibers listed in the following Table 1 can be preferably used. As for the plastic, thermosetting plastics, preferably epoxy resins can be used. In order to achieve the moldability and strength, the plastic content is preferably set in the range of from 20 to 25 weight %.

TABLE 1

| Manufacturer | Elastic modulus | |
|---|---|---|
| Carbon fiber | ton/sq.mm | GPa |
| Mitsubishi Rayon Co., Ltd. | | |
| TR50S | 24.5 | 240.3 |
| MR40 | 30.0 | 294.2 |
| HR40 | 40.0 | 392.3 |

TABLE 1-continued

| Manufacturer | Elastic modulus | |
|---|---|---|
| Carbon fiber | ton/sq.mm | GPa |
| Toray Industries, Inc. | | |
| T700S | 23.5 | 230.5 |
| T300 | 23.5 | 230.5 |
| T800H | 30.0 | 294.2 |
| M30SC | 30.0 | 294.2 |
| M40J | 38.5 | 377.6 |
| M46J | 46.0 | 451.1 |
| T700G | 25.5 | 249.9 |
| M30S | 30.0 | 294.2 |
| TOHO TENAX Co., Ltd. | | |
| UT500 | 24.5 | 240.3 |
| HTA | 24.0 | 235.4 |
| IM400 | 30.0 | 294.2 |
| Nippon Graphite Fiber Corporation | | |
| YS-80 | 80.0 | 784.5 |

The face member 1A comprises: a face plate 8 forming at least major part of the club face 2 including the centroid of the club face; and optionally a turnback 9 integrally formed with the face plate 8 and extending backwards from at least a part of the peripheral edge of the club face 2.

As for the metal material of the face member 1A, various materials may be used, but titanium alloys, aluminum alloys, pure titanium and stainless steel are preferred. In the case of titanium alloys, preferably used are alpha-beta titanium alloys and beta titanium alloys, e.g. Ti-6Al-4V (specific gravity 4.42), Ti-10V-2Fe-3Al (specific gravity 4.65), Ti-15V-3Cr-3Sn-3Al (specific gravity 4.76), Ti-4.5Al-3V-2Fe-2Mo (specific gravity 4.60), Ti-5.5Al-1Fe (specific gravity 4.38), Ti-15Mo-5Zr-3Al (specific gravity 4.95), Ti-22V-4Al (specific gravity 4.69), Ti-15V-6Cr-4Al (specific gravity 4.72 to 4.74) and the like.

The face member 1A can be manufactured by forging, press working, casting or the like.

Figure 3:
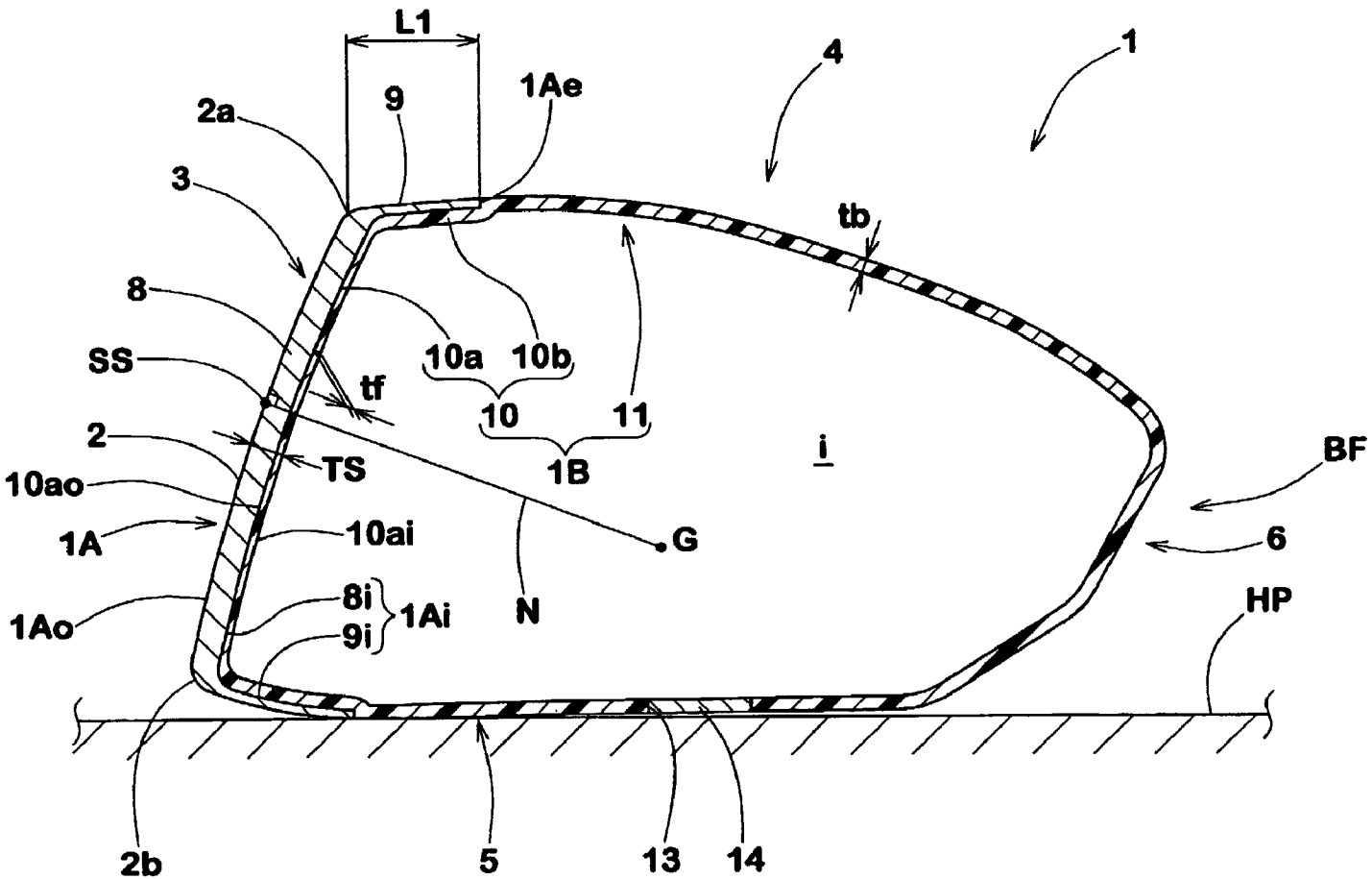
FIG. 3 is a cross sectional view taken along line X-X in FIG. 2 showing an embodiment of the present invention.
Figure 4:
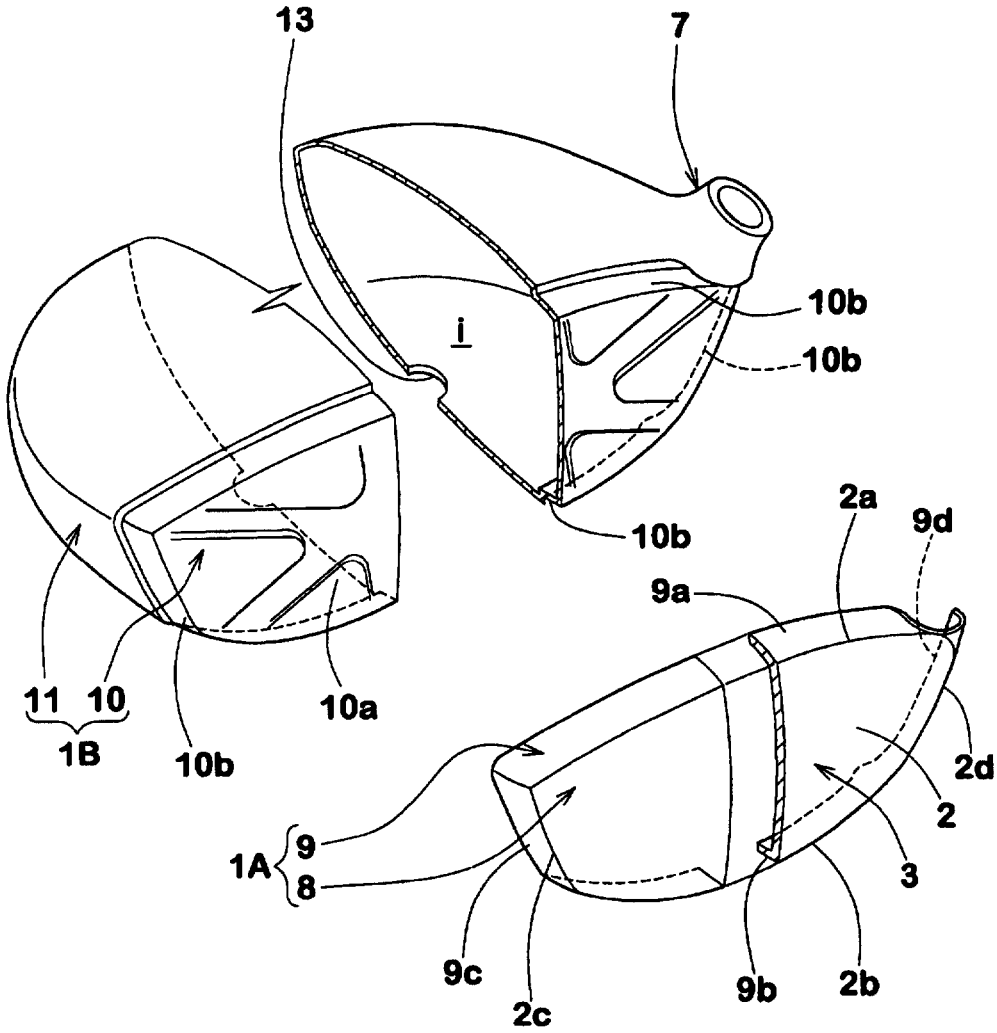
FIG. 4 is an exploded perspective view showing a face member and a main body of the golf club head.
Figure 5:
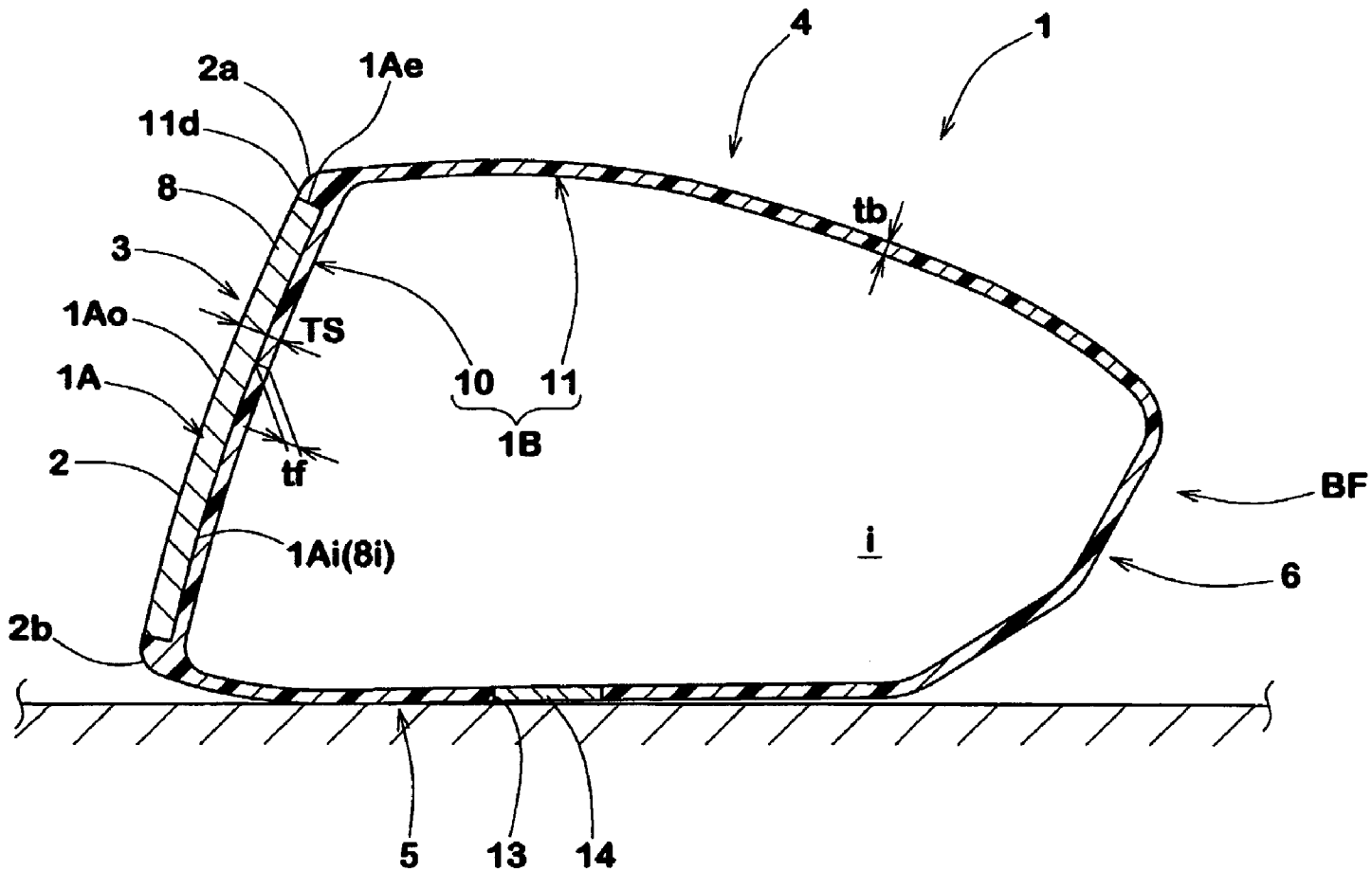
FIG. 5 is a cross sectional view similar to FIG. 3 showing another embodiment of the present invention.

In FIGS. 3 and 4 showing an embodiment of the present invention, the face member 1A is composed of the face plate 8 and the turnback 9. In FIG. 5 showing a further embodiment, the face member 1A is composed of the face plate 8 only. In this case, the face plate 8 forms a major part of the club face 2 more than 70%, preferably more than 80% of the entirety, but preferably less than 100%. In the former example, contrary, the face plate 8 forms the entirety of the club face 2. The turnback 9 is formed along almost entirety of the peripheral edge, namely the edges 2*a*, 2*b*, 2*c* and 2*d*, excepting a part getting away from the hosel portion 7. Therefore, the turnback 9 included a crown-side turnback 9*a* along the upper edge 2*a*, a sole-side turnback 9*b* along the lower edge 2*b*, a toe-side turnback 9*c* along the toe-side edge 2*c* and a heel-side turnback 9*d* along the heel-side edge 2*d*. As one of modifications, for example, the turnback 9 may be composed of the crown-side turnback 9*a* and sole-side turnback 9*b* only.

The width L1 of the turnback 9 measured in the back-and-forth direction is preferably set in the range of not less than 10 mm, more preferably not less than 15 mm, but not more than 30 mm, more preferably not more than 26 mm.

In the description, the dimensions refer to the values measured under the standard state of the club head unless otherwise noted. The standard state of the club head is such that the club head is set on a horizontal plane HP so that the axis of the clubshaft (not shown) is inclined at the lie angle while keeping the axis on a vertical plane, and the club face forms its loft angle with respect to the horizontal plane HP. Incidentally, in the case of the club head alone, the center line of the shaft inserting hole 7*a* can be used instead of the axis of the clubshaft. The back-and-forth direction is a direction parallel with the straight line N projected on the horizontal plane HP. The undermentioned sweet spot SS is the point of intersection between the club face and a straight line N drawn normally to the club face passing the center of gravity G of the head. (see FIG. 3)

The face member 1A is bonded to a front portion 10 of the main body 1B. The front portion 10 includes a front wall 10*a* of which outer surface 10*ao* is bonded to the inner surface 8*i* of the face plate 8 with no space therebetween. In the first embodiment, as the face member 1A has the turnback 9, the front portion 10 further includes a periphery wall 10*b* of which outer surface is bonded to the inner surface 9*i* of the turnback 9 with no space therebetween. Therefore, the outside of the front portion 10 is covered with the face member 1A, and the front portion 10 has a double layered structure. But, the rear portion 11 of the main body 1B other than the front portion 10 is not covered, and the outer surface of the rear portion 11 together with the outer surface of the face member 1A defines the surface of the club head which may be coated with a paint or the like.

If the thickness tb of the rear portion 11 is less than 0.3 mm, it is difficult to maintain the necessary durability of the club head. If more than 3.5 mm, as the club head is increased in the weight, the advantage of adopting the hybrid structure is nullified. Therefore, the thickness tb is set in a range of not less than 0.3 mm, preferably not less than 0.5 mm, more preferably not less than 0.8 mm, but not more than 3.5 mm, preferably not more than 3.2 mm, more preferably not more than 3.0 mm.

If the thickness tf of the front portion 10 is less than 0.6 mm, as the rigidity of the front wall 10*a* and periphery wall 10*b* becomes insufficient, it is difficult to maintain the bonding strength to the face member 1A. If more than 2.5 mm, it becomes difficult to set the center of gravity distance at an adequate depth. Therefore, the thickness tf is set in a range of not less than 0.6 mm, preferably not less than 0.8 mm, more preferably not less than 1.0 mm, but not more than 2.5 mm, preferably not more than 2.2 mm, more preferably not more than 2.0 mm.

At the boundary between the face member 1A and the main body 1B, the outer surface of the face member 1A is flush with the outer surface of the main body 1B. In the case of FIG. 3, therefore, a step corresponding to the thickness of the turnback 9 is formed between the outer surface of the periphery wall 10*b* and the adjacent outer surface of the rear portion 11. In the case of FIG. 5, an annular protrusion 11*d* or an increased thickness part which surrounds the face member 1A like a frame is formed at the front of the main body 1B along the peripheral edge (2*a*-2*d*) of the club face 2.

The thickness TS of the face portion 3 that is the sum of the thickness of the face plate 8 and the thickness of the front wall 10*a* is set in a range of not more than 4.5 mm, preferably not more than 4.3 mm, more preferably not more than 4.1 mm, but not less than 2.6 mm, preferably not less than 2.8 mm, more preferably not less than 3.0 mm. If more than 4.5 mm, it is difficult to avoid an unfavorable increase in the weight of the face portion 3. If less than 2.6 mm, it is difficult to provide a sufficient strength for the face portion 3.

The club face 2 or the outer surface of the face plate 8 can be provided in the impact area with grooves or punch marks if desired. Excepting such grooves or punch marks, the outer surface is smooth. In contrast, the inner surface 8*i* of the face plate 8 is provided with a patterned protuberance.

Figure 6:
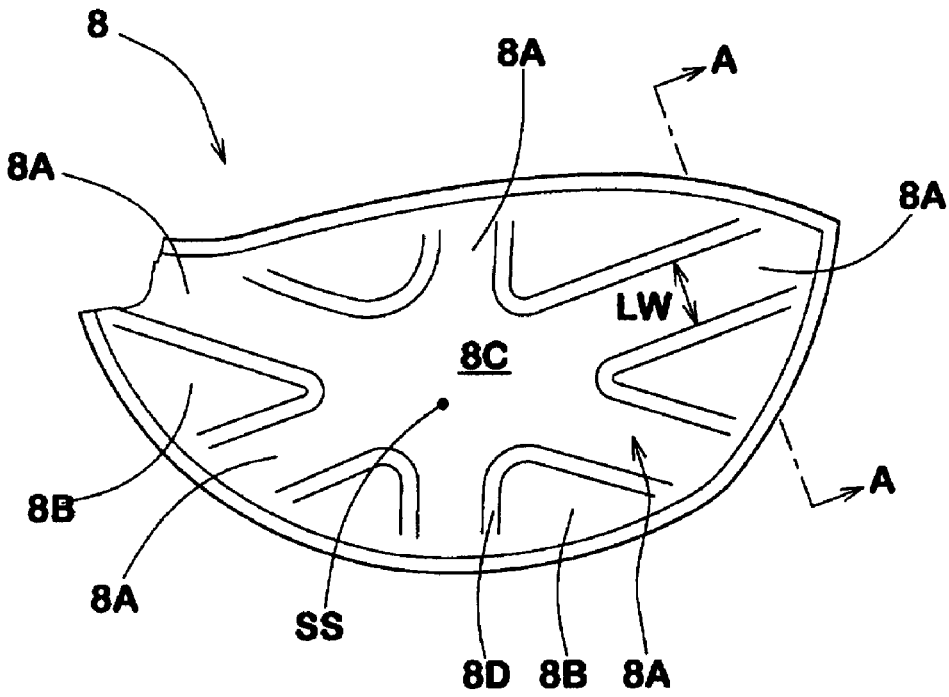
FIG. 6 is a back view of the face plate.
Figure 7:
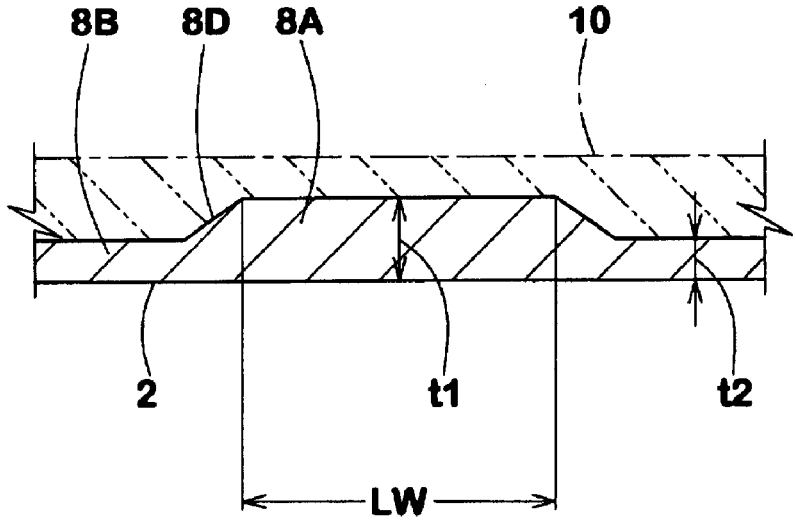
FIG. 7 is an enlarged cross sectional view of a protuberant part of the face plate.

FIG. 6 shows an example of the patterned protuberance. The patterned protuberance comprises a central portion 8*c* and a plurality of radial portions 8A, wherein the central portion 8*c* includes the sweet spot SS, and the radial portions 8A extend radially from the central portion 8C to the peripheral edge of the face plate 8. As a result, between the radial portions 8A, relatively thin portions 8B are formed around the central portion 8C. The thin portions 8B have a substantially constant thickness t2. The central portion 8C and radial portions 8A have a substantially constant thickness t1. In order to gradually change the thickness from t1 to t2, variable thickness portions 8D are formed between the thick portions 8C and 8A and the thin portions 8B. By such arrangement, a weight reduction and an improvement in the restitution coefficient are possible, while maintaining the strength and durability of the face plate 8.

On the other hand, the front wall 10*a* of the main body 1B has the outer surface 10*ao* which is provided with a patterned indentation as shown in FIG. 4 so as to fit to the above-mentioned inner surface 8*i* of the face plate 8.

The inner surface 10*ai* of the front wall 10*a* can be smooth and accordingly substantially parallel with the club face 2, but in the embodiments, as the front wall 10*a* is formed with a constant thickness, the inner surface 10*ai* also has a similar patterned protuberance to that of the face plate.

In view of the strength of the face plate 8, the minimum width LW of each of the radial portions 8A is set in a range of not less than 6 mm, preferably not less than 8 mm, but not more than 17 mm, preferably not more than 15 mm.

The number of the radial portions 8A is not less than 4, preferably not less than 6, but not more than 10. In the FIG. 6 example, the number of the radial portions 8A is six, and each radial portion 8A has one radial portion in line therewith on the opposite side of the central portion 8C. The central portion 8C is broader than the width LW of the radial portions 8A.

The thickness t2 of the thin portions 8B is preferably set in a range of not more than 1.9 mm, more preferably not more than 1.8 mm, still more preferably not more than 1.7 mm, but not less than 1.4 mm, more preferably not less than 1.5 mm, still more preferably not less than 1.6 mm. If more than 1.9 mm, it becomes difficult to improve the restitution coefficient. If less than 1.4 mm, as the strength decreases, the durability of the face portion 3 tends to decrease.

The thickness t1 of the thick portions 8C and 8A is preferably set in a range of not less than 2.0 mm, more preferably not less than 2.1 mm, still more preferably not less than 2.2 mm, but not more than 2.7 mm, more preferably not more than 2.6 mm, still more preferably not more than 2.5 mm. If less than 2.0 mm, it becomes difficult to provide a sufficient strength for the face plate 8. If more than 2.7 mm, it becomes difficult to avoid an unfavorable weight increase in the face portion 3.

In order to avoid large unbalance of the strength or rigidity, it is desirable that the average t3 (=(t1+t2)/2) of the thickness t1 and thickness t2 is set in a range of not less than 1.70 mm, more preferably not less than 1.75 mm, still more preferably not less than 1.80 mm, but not more than 2.1 mm, more preferably not more than 2.05 mm, still more preferably not more than 2.0 mm. Further, it is desirable that the ratio (t1/t2) is set in a range of 1.2 to 1.7. If less than 1.2, it becomes difficult to improve the rebound performance and bonding strength at the same time. If more than 1.7, there is a possibility that the rebound performance is deteriorated and the weight is increased due to the increase in the thickness t1 or alternatively there is a possibility that the strength is decreased due to the decrease in the thickness t2.

By the patterned protuberance and indentation which can engage with each other, the bonding strength between the face member and main body can be improved. Further, undesirable vibrations at impact can be reduced since the vibrations becomes more multimode.

The main body 1B can be manufactured by pressure bag molding in which a sprit mold M and a bag B which is inflatable like a rubber balloon are used.

Figure 8:
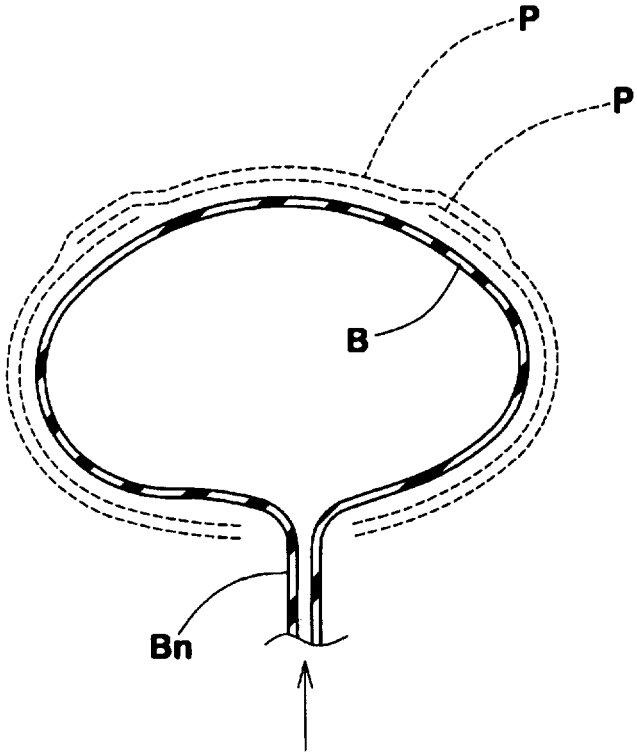
FIGS. 8 and 9 are cross sectional views for explaining a method for manufacturing the main body.

As shown in FIG. 8, prepreg sheets P are applied to the outer surface of the bag B which is inflated to a certain degree with air so that the applied prepreg sheets P cover the entire outer surface of the bag B excepting a tube Bn.

Figure 9:
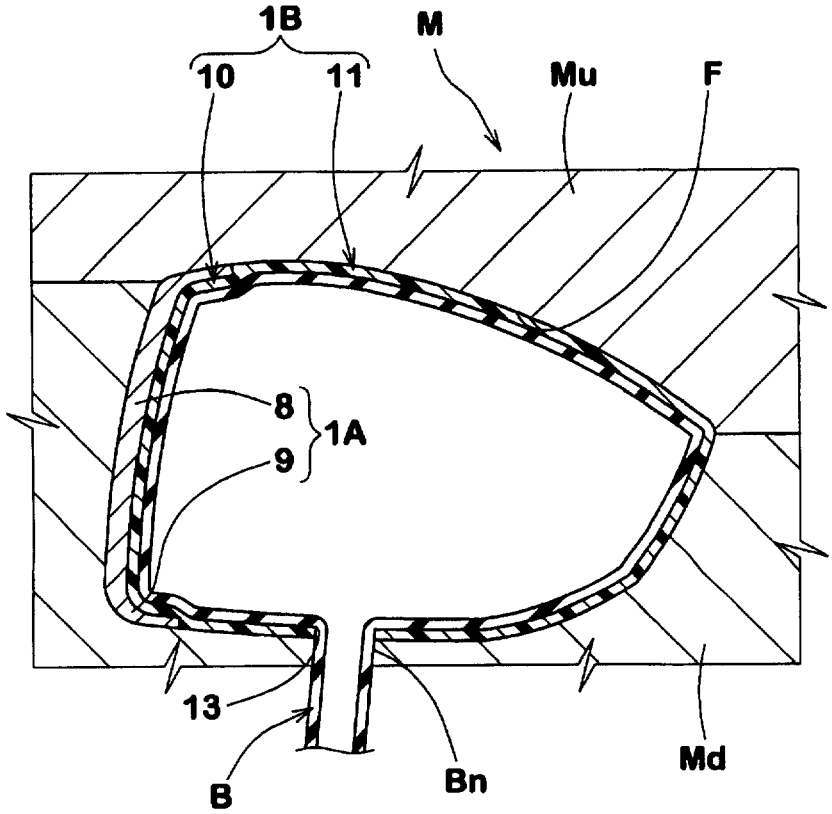

Then, the bag B and the applied prepreg sheets P are placed in the mold M in which the face member 1A is set in advance as shown in FIG. 9. The sprit mold M comprises for example an upper die Mu and a lower die Md. An adhesive agent for example a heat-hardening type may be applied to the inner surface 1Ai of the face member 1A in advance to ensure the bonding.

The mold M is heated, and the bag B is fully inflated with a heating medium injected using the tube Bn so that the prepreg sheets P are pressed by the bag B against the molding surface F of the mold. Therefore, the prepreg sheets are cured and molded into the main body 1B.

After cured, the bag B is deflated and removed from the inside of the main body 1B, using a small hole 13 formed by the tube Bn which is in this example positioned in the sole portion.

The main body 1B with the face member 1A is demolded. The hole 13 is closed by a separate patch 14. The patch 14 can be made of a fiber-reinforced plastic, rubber, metal, plastic alone or the like.

Aside from the above-explained way in which the face member 1A is placed in the mold M, as another method of bonding the face member to the main body, it is also possible to form the main body using a mold without the face member 1A, and then the face member 1A is fitted and adhered to the front portion of the main body 1B by the use of an adhesive agent.

As the adhesive agent, for example, two-part room temperature curing epoxy adhesives (e.g. "DP-420" Sumitomo 3M Ltd.), one-part thermosetting epoxy adhesives (e.g. "EW2050" Sumitomo 3M Ltd.), two-part denatured acrylate-based adhesives (e.g. "HARDLOC" Denki Kagaku Kogyo KK), two-part reactive acrylic adhesives (e.g. "Y-620" cemedine Co., Ltd.) and the like can be preferably used alone or in combination.

Further, depending on the shape of the main body, the main body may be manufactured by injection molding, using a fluid plastic matrix in which short fibers and additives are mixed. In this case, the fibers will have random orientation in contrast to the former embodiments.

Incidentally, the prepreg is as well known in the art, a sheet of reinforcing fibers impregnated with a thermosetting resin. In this invention, unidirectional prepreg, non-directional prepreg and/or woven prepreg can be used according to need.

The main body 1B can be provided with an opening or hole for the purpose of mounting a weight, reinforcing member, ornament or the like in addition to the above-mentioned hole 13. But, in view of the strength of the monocoque main body, irrespective of whether remained to be opened or closed, the total area of such opening or openings is preferably in a range of not more than 30%, more preferably not more than 20%, still more preferably not more than 10% of the overall surface area of the main body.

Comparison Tests

The following wood club heads having a head volume of 460 cc were prepared and tested for the durability and rebound performance.

WORKING EXAMPLE 1 TO 8

The main body was made from prepreg of an epoxy resin ("350 plastic" Mitsubishi Rayon Co., Ltd.) and carbon fibers having a tensile elastic modulus of 240.3 GPa ("TR50S" Mitsubishi Rayon Co., Ltd.) by the pressure bag molding method as explained above in conjunction with FIGS. 8 and 9. The prepreg sheets were applied to the bag so as to form a five-layered structure. The hole 13 was patched with a plastic badge. The face member was made of Ti-5.5Al-1Fe ("super TI-X 51AF" Nippon steel corporation). The face member was bonded to the main body by placing the face member in the mold.

WORKING EXAMPLES 1 TO 7

The face member was formed by forging and made up of the face plate and turnback as shown in FIGS. 3 and 4.

WORKING EXAMPLE 1

The face plate had a constant thickness.

WORKING EXAMPLE 2 TO 7

The face plate was provided with the patterned protuberance shown in FIG. 6.

WORKING EXAMPLE 8

The face member was the face plate only as shown in FIG. 5. The face plate had a constant thickness.

COMPARATIVE EXAMPLES 1 AND 2

Figure 11:
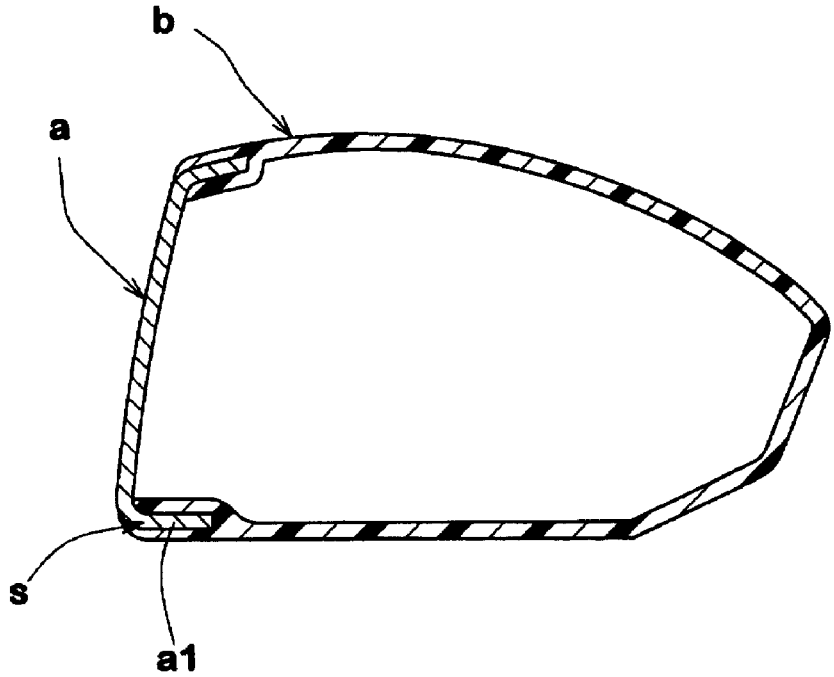
FIG. 11 is a cross sectional view of the prior-art golf club head.

As shown in FIG. 11, the head was composed of an open-front main body and a face member with a turnback. The materials and manufacturing methods of the face member and main body were same as those of working example 1 to 7.

COMPARATIVE EXAMPLE 3

Figure 10:
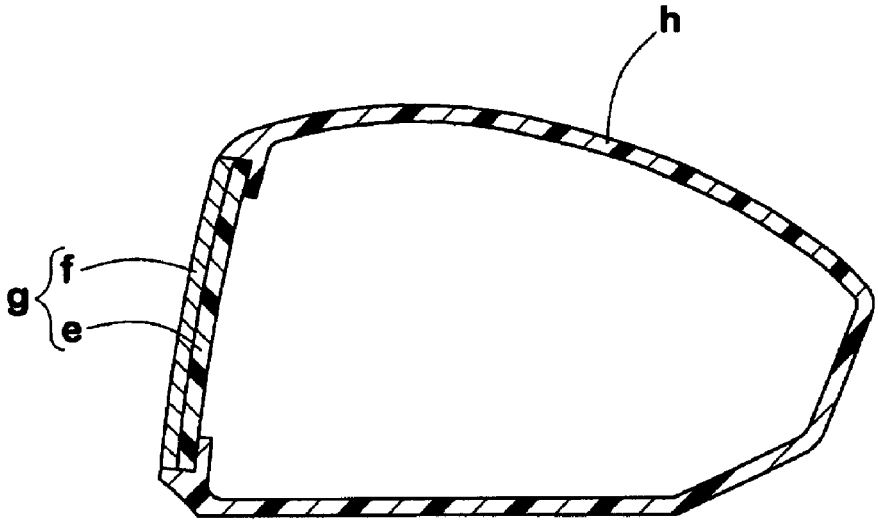
FIG. 10 is a cross sectional view of a golf club head used in the undermentioned comparative tests.

The head had the structure shown in FIG. 10, wherein a metal plate (f) formed by press molding and a fiber-reinforced plastic plate (e) formed using a mold were bonded to each other by an adhesive so as to form a hybrid face plate (g), and an open-front main body (h) was made from the fiber-reinforced plastic. The hybrid face plate (g) was fitted in the front opening of the main body (h) and fixed by the use of an adhesive. The metal material and fiber-reinforced plastic were same as those of working example 1 to 7.

Durability Test

The heads were attached to identical FRP shafts and 45-inch wood clubs were fabricated. Each club was attached to a swing robot and hit golf balls at the center of the club face 1000 times max. at a head speed 50 m/s. The results are shown in Table 2, wherein "A" means 1000 hits were completed without any damage of the head, and "B" means 1000 hits could be completed but a crack was found in the club face. When the head was broken before reaching to 1000 hits, the number of the hits accomplished is indicated.

Rebound Performance Test

According to the "Procedure for Measuring the Velocity Ratio of a Club Head for Conformance to Rule 4-1*e*, Appendix II, Revision 2 (Feb. 8, 1999), United States Golf Association", the restitution coefficient (e) of each club head was obtained. The results are shown in Table 2.

Form the test results, it was confirmed that working examples had high durability in comparison with Comparative examples, and Working examples 1 to 7 with the turnback had higher durability and higher rebound performance in comparison with Working example 8 without the turnback, and further Working example 2 to 7 with the patterned protuberance had the durability and rebound performance both raising to a higher dimension when compared with working example 1 without such protuberance.

The present invention is suitably applied to relatively large sized hollow club head as explained above, but it is also possible to apply to utility-type heads further iron-type heads as far as the head has a hollow structure.

TABLE 2

| Golf club head | Comp. Ex. 1 | Comp. Ex. 2 | Comp. Ex. 3 | Work. Ex. 1 | Work. Ex. 2 | Work. Ex. 3 | Work. Ex. 4 | Work. Ex. 5 | Work. Ex. 6 | Work. Ex. 7 | Work. Ex. 8 |
|---|---|---|---|---|---|---|---|---|---|---|---|
| | FIG. 11 | FIG. 11 | FIG. 10 | FIG. 3 | FIG. 3 | FIG. 3 | FIG. 3 | FIG. 3 | FIG. 3 | FIG. 3 | FIG. 5 |
| Mass (gram) | 210 | 190 | 190 | 190 | 190 | 190 | 190 | 190 | 190 | 190 | 190 |
| Face portion | | | | | | | | | | | |
| Max. thickness (mm) | 2.8 | 2.3 | 3.0 | 3.0 | 3.1 | 3.2 | 3.4 | 3.5 | 3.7 | 4.0 | 3.0 |
| Min. thickness (mm) | 2.8 | 2.3 | 2.0 | 3.0 | 2.9 | 2.8 | 2.6 | 2.5 | 2.3 | 2.0 | 3.0 |
| Face member | | | | | | | | | | | |
| Turnback | FIG. 4 | FIG. 4 | non | FIG. 4 | FIG. 4 | FIG. 4 | FIG. 4 | FIG. 4 | FIG. 4 | FIG. 4 | non |
| Face plate | | | | | | | | | | | |
| Max. thickness t1 (mm) | 2.8 | 2.3 | 2.0 | 2.0 | 2.1 | 2.2 | 2.4 | 2.5 | 2.7 | 3.0 | 2.0 |
| Min. thickness t2 (mm) | 2.8 | 2.3 | 2.0 | 2.0 | 1.9 | 1.8 | 1.6 | 1.5 | 1.3 | 1.0 | 2.0 |
| t1/t2 | 1.0 | 1.0 | 1.0 | 1.0 | 1.1 | 1.2 | 1.5 | 1.7 | 2.1 | 3.0 | 1.0 |
| Main body | | | | | | | | | | | |
| Front wall thickness tf* (mm) | — | — | 1.0 | 1.0 | 1.0 | 1.0 | 1.0 | 1.0 | 1.0 | 1.0 | 1.0 |

TABLE 2-continued

| Golf club head | Comp. Ex. 1 | Comp. Ex. 2 | Comp. Ex. 3 | Work. Ex. 1 | Work. Ex. 2 | Work. Ex. 3 | Work. Ex. 4 | Work. Ex. 5 | Work. Ex. 6 | Work. Ex. 7 | Work. Ex. 8 |
|---|---|---|---|---|---|---|---|---|---|---|---|
| Test results | | | | | | | | | | | |
| Durability | 500 | 100 | 300 | 900 | B | A | A | A | A | B | 800 |
| Restitution coefficient | 0.802 | 0.860 | 0.841 | 0.848 | 0.850 | 0.851 | 0.852 | 0.853 | 0.853 | 0.854 | 0.842 |

*In Comparative example 3, the thickness of the wall formed around the opening to support the back face of the hybrid face plate (g) is indicated.

The invention claimed is:

1. A hollow golf club head comprising:

a main body which is a hollow shell structure made of a fiber-reinforced plastic, wherein the main body comprises a face portion; a crown portion; a sole portion; a side portion between the crown portion and sole portion which extends from a toe-side edge to a heel-side edge of the club face through the back face of the club head; and a hosel portion in an integrated manner, and the front of the main body has no opening; and a face member covering a front portion of the main body and bonded thereto, wherein the face member comprises a face plate forming the entirety of the club face, and a turnback formed along the peripheral edge of the face plate excepting only the hosel portion, the face member being made of a metal material by forging or press working, and the size of the turnback measured in the back-and-forth direction of the head being at most 26 mm, whereby said front portion of the main body covered with the face member comprises a front wall with an outer surface bonded to an inner surface of the face plate, and a periphery wall with an outer surface bonded to an inner surface of the turnback, wherein the inner surface of the face plate is provided with a patterned protuberance, and the outer surface of the front wall is provided with a patterned indentation so as to fit to the inner surface of the face member, the total thickness of the face plate and the front wall is in a range of not more than 4.5 mm but not less than 2.6 mm, the thickness (tf) of the front portion of the main body is in a range of not less than 0.6 mm but not more than 2.0 mm, and the thickness (tb) of a rear portion of the hollow shell structure other than said front portion is in a range of not less than 0.8 mm, but not more than 3.5 mm.

2. The golf club head according to claim 1, wherein the face plate has a maximum thickness t1 and a minimum thickness t2, and the ratio (t1/t2) therebetween is in a range of from 1.2 to 1.7.

3. The golf club head according to claim 1, wherein the patterned protuberance comprises a central portion and radial portions extending radially from the central portion.

4. The golf club head according to claim 3, wherein the central portion of the patterned protuberance includes the sweet spot SS, each of the radial portions of the patterned protuberance extends continuously from the central portion to its end near the edge of the club face, and the central portion and the radial portions have substantially the same thickness.

5. The golf club head according to claim 3, wherein the central portion of the patterned protuberance includes the sweet spot SS, each of the radial portions of the patterned protuberance extends continuously from the central portion to its end near the edge of the club face, the central portion and the radial portions have substantially the same thickness, and the number of the radial portions is six.

6. The golf club head according to claim 1, wherein the main body has a total opening area of not more than 10% of the overall surface area of the main body.

7. The golf club head according to claim 1, wherein the thickness of the front wall is substantially constant.

8. The golf club head according to claim 1, wherein the size of the turnback measured in the back-and-forth direction of the head is substantially constant along the peripheral edge of the face plate excepting said part.

9. The golf club head according to claim 1, wherein the main body has a small hole positioned in the sole portion and closed by a separate patch.

* * * * *